US005590826A

United States Patent [19]

Endo

[11] Patent Number: 5,590,826

[45] Date of Patent: Jan. 7, 1997

[54] PROTECTOR

[75] Inventor: Yoichi Endo, 5-1-15, Jingumae, Shibuya-ku, Tokyo 150, Japan

[73] Assignees: Sakase Textile Co., Ltd., Sakai-gun; Yoichi Endo, Tokyo, both of Japan

[21] Appl. No.: 384,390

[22] Filed: Feb. 3, 1995

Related U.S. Application Data

[63] Continuation of Ser. No. 123,266, Sep. 20, 1993, abandoned.

[30] Foreign Application Priority Data

Sep. 21, 1992 [JP] Japan ..... 4-294716
Apr. 22, 1993 [JP] Japan ..... 5-117597

[51] Int. Cl.[6] ..... A41F 15/02

[52] U.S. Cl. ..... 224/264; 224/257

[58] Field of Search ..... 224/264, 257, 224/265, 266; 428/156; 2/45, 268, 267

[56] References Cited

U.S. PATENT DOCUMENTS

| | | | |
|---|---|---|---|
| 2,608,726 | 8/1952 | Spector | 224/264 |
| 2,714,979 | 8/1955 | McCarthy | 224/264 |
| 2,808,973 | 10/1957 | Gobble | 224/264 |
| 4,887,318 | 12/1989 | Weinreb | 224/264 |
| 4,942,995 | 7/1990 | Myers | 224/264 |
| 5,207,364 | 5/1993 | Johnson | 224/264 |
| 5,250,345 | 10/1993 | Chu | 224/264 |

*Primary Examiner*—David J. Walczak
*Attorney, Agent, or Firm*—Armstrong, Westerman, Hattori, McLeland & Naughton

[57] ABSTRACT

A protector for protecting a human body against local load such as a load applied to a shoulder through a strap suspending a heavy article such as a bag. The protector has a protector member the surface of which contactable with the human body is configured in conformity with the configuration of the local portion of the human body, e.g., a shoulder. The protector member may be provided with a strap support for supporting the strap and a strap retainer for retaining the strap on the strap support. The protector member has a high rigidity and a considerable area so as to distribute the load over a wider area on the local portion of the human body, thereby unburdening the load portion of the body, thus preventing fatigue, pair or other undesirable effect which otherwise may be caused by concentration of the load to a limited area.

12 Claims, 14 Drawing Sheets

FIG. 1(a)
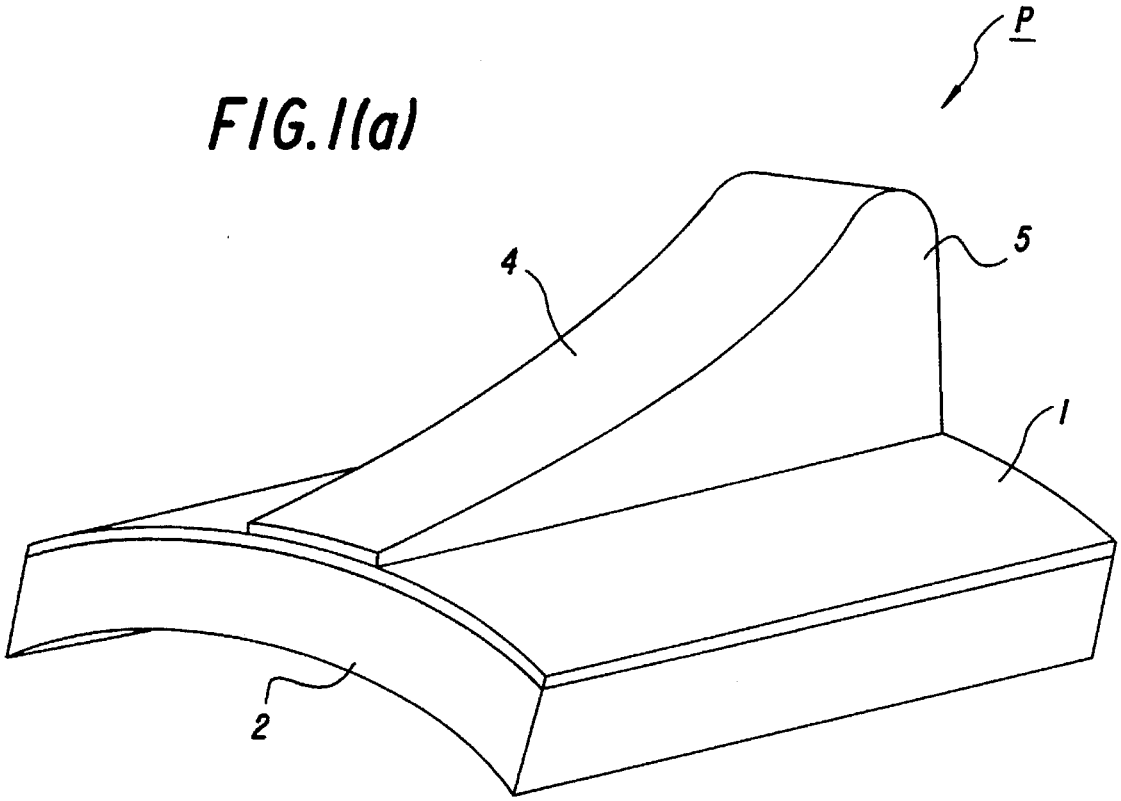
FIG. 1(b)
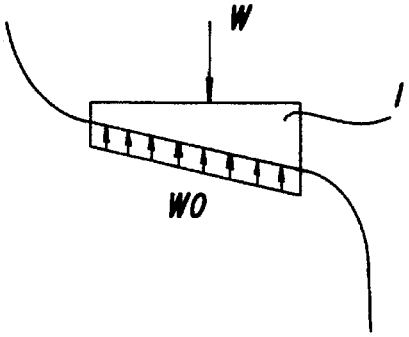
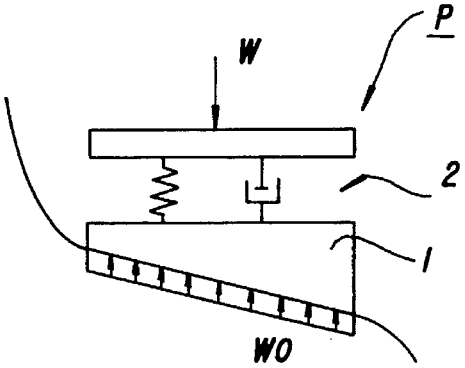
FIG. 1(c)

FIG.5(a)
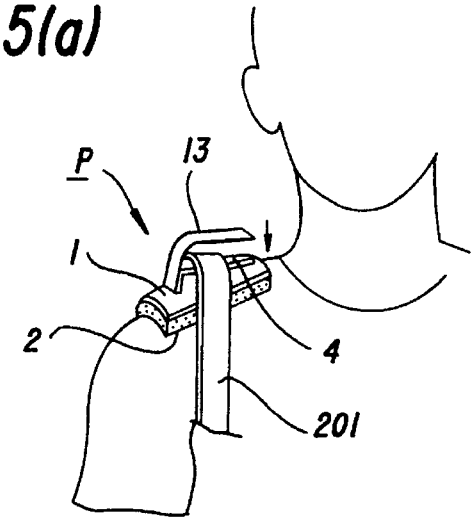
FIG.5(b)
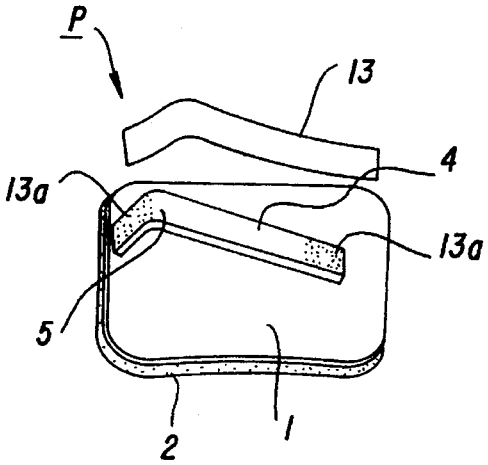
FIG.6(a)
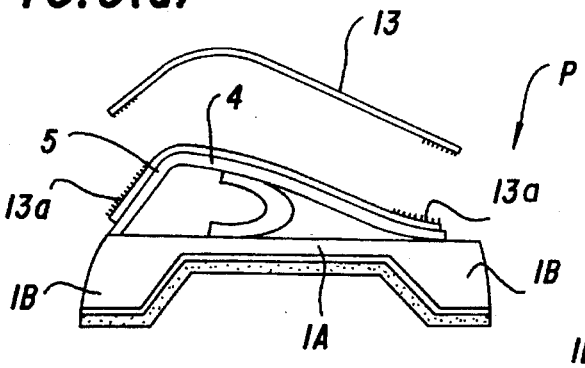
FIG.6(c)
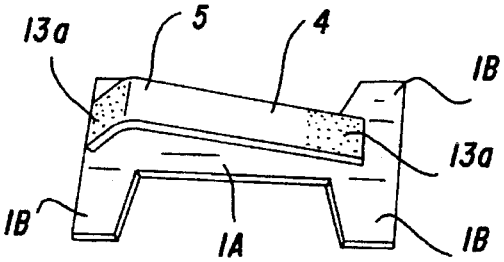
FIG.6(b)
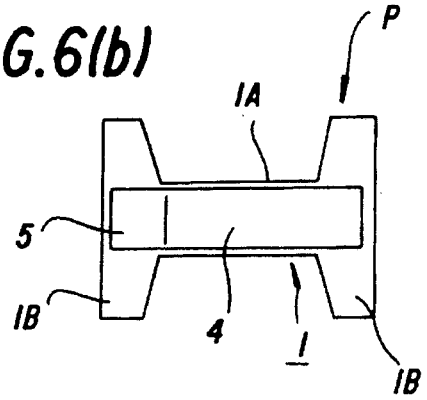
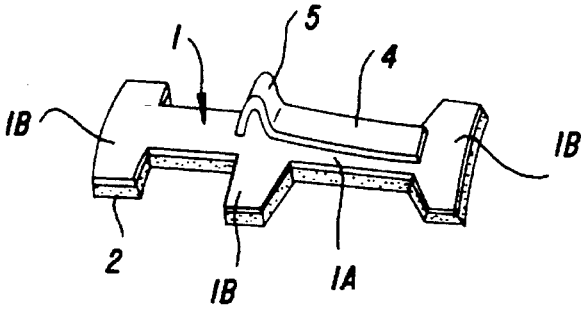
FIG.6(d)

FIG. 7(a)
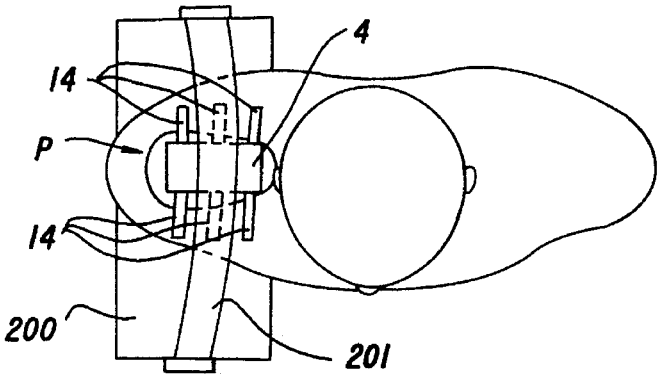
FIG. 7(b)
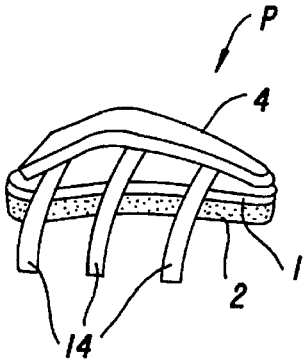
FIG. 8
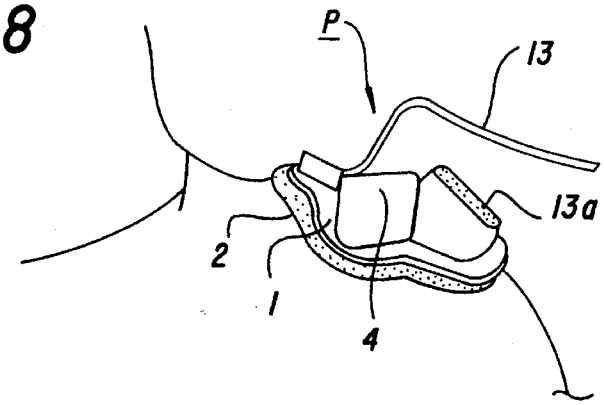
FIG. 9(a)
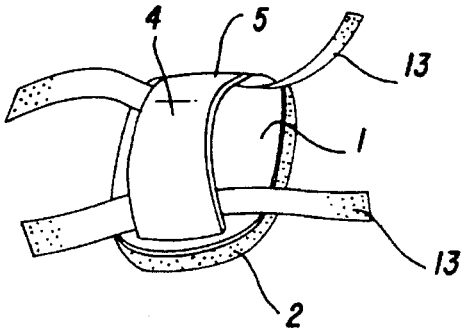
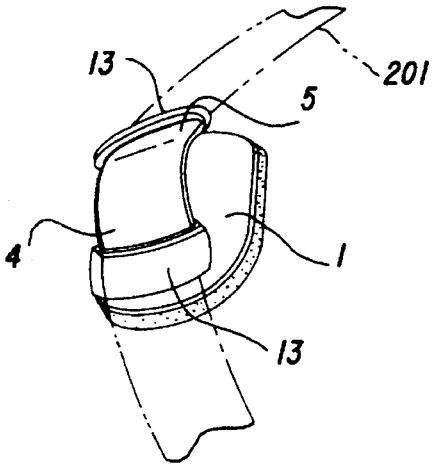
FIG. 9(b)

FIG.10
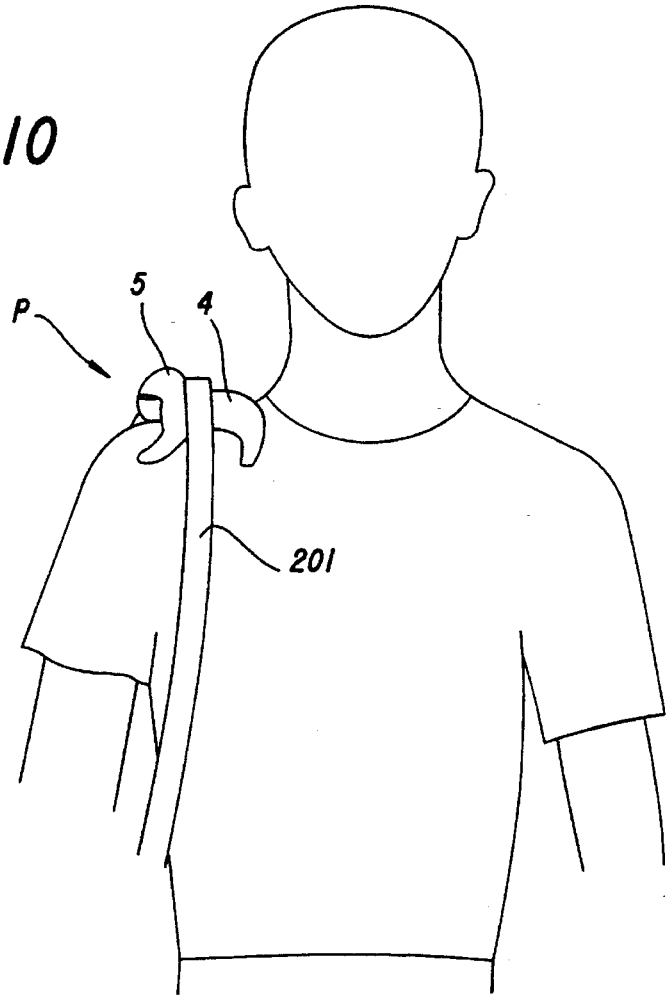
FIG.11(a)
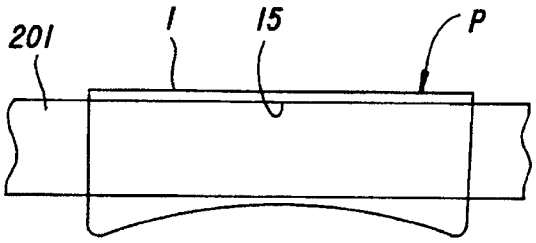
FIG.11(c)
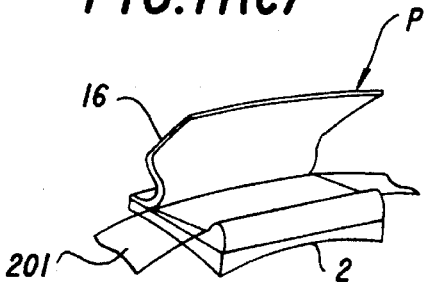
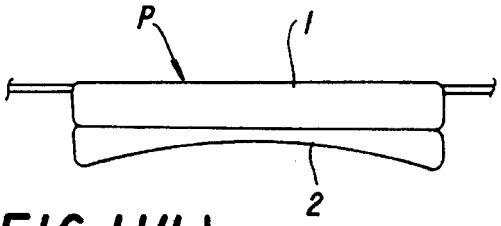
FIG.11(b)
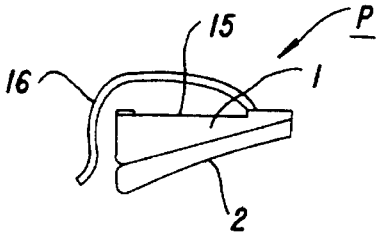
FIG.11(d)

FIG.13(a)
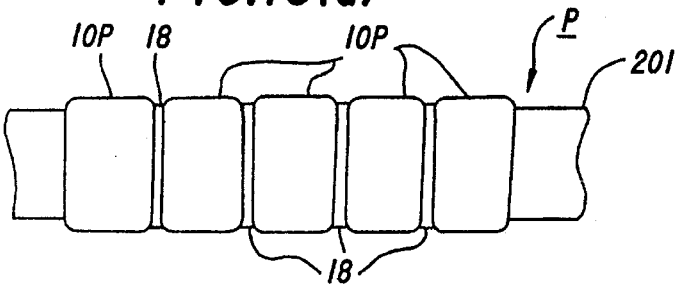
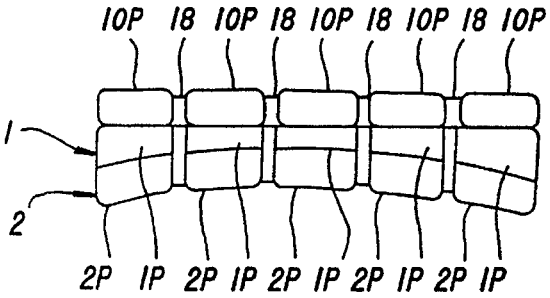
FIG.13(b)
FIG.13(c)
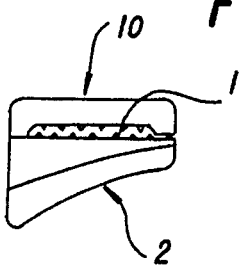
FIG.13(f)
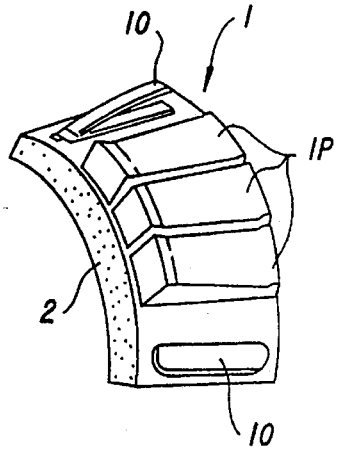
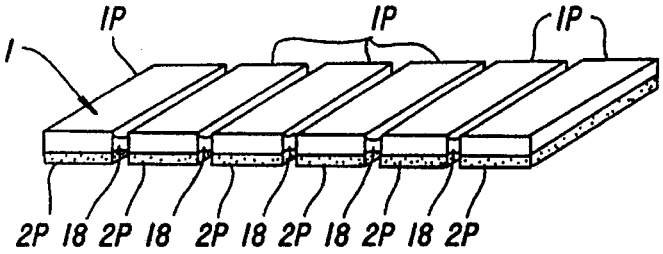
FIG.13(d)
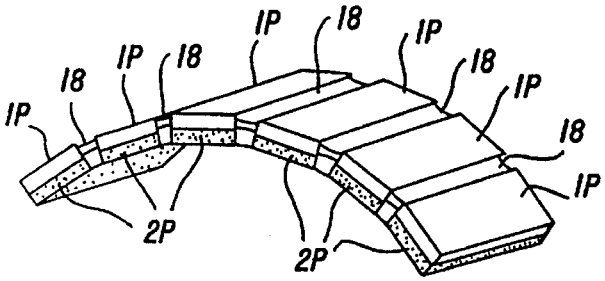
FIG.13(e)
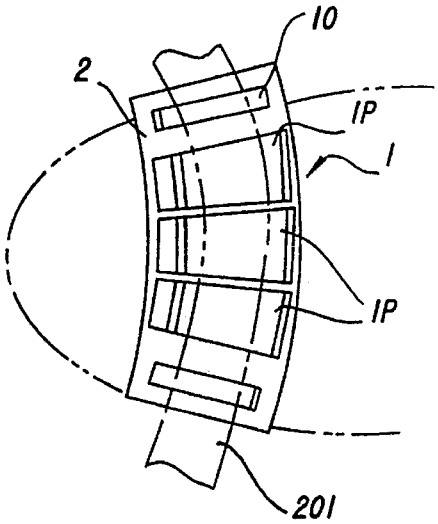
FIG.13(g)

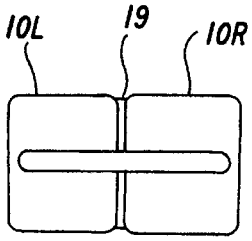
FIG.14(a)
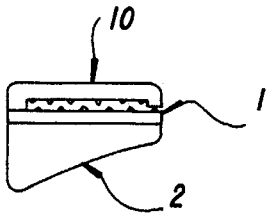
FIG.14(b)
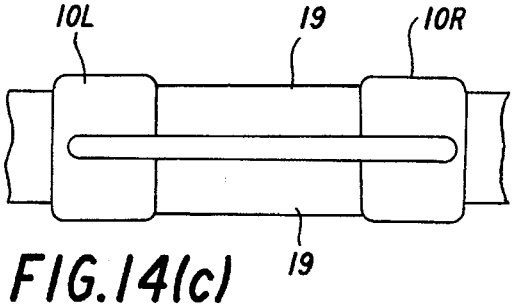
FIG.14(c)
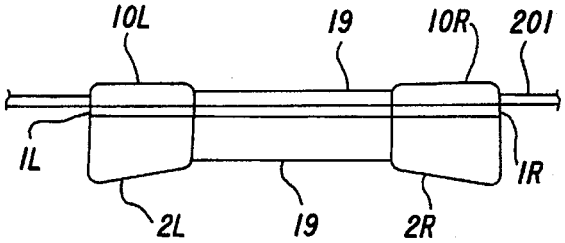
FIG.14(d)
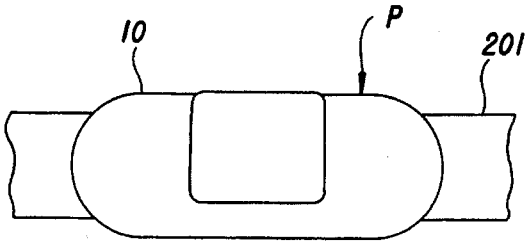
FIG.15(a)
FIG.15(b)
FIG.15(d)
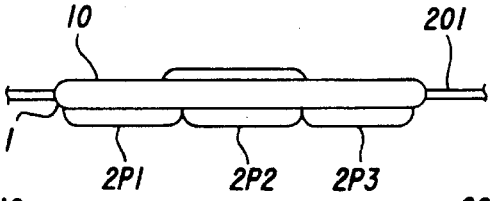
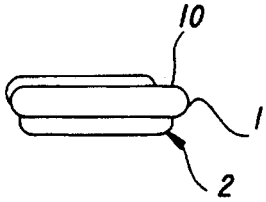
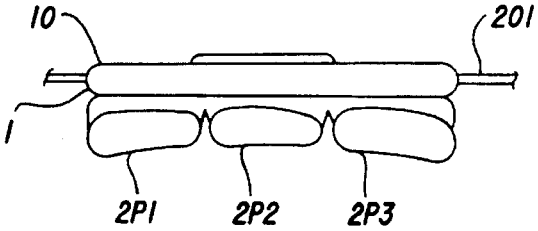
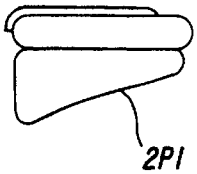
FIG.15(c)
FIG.15(e)

FIG.16(a)
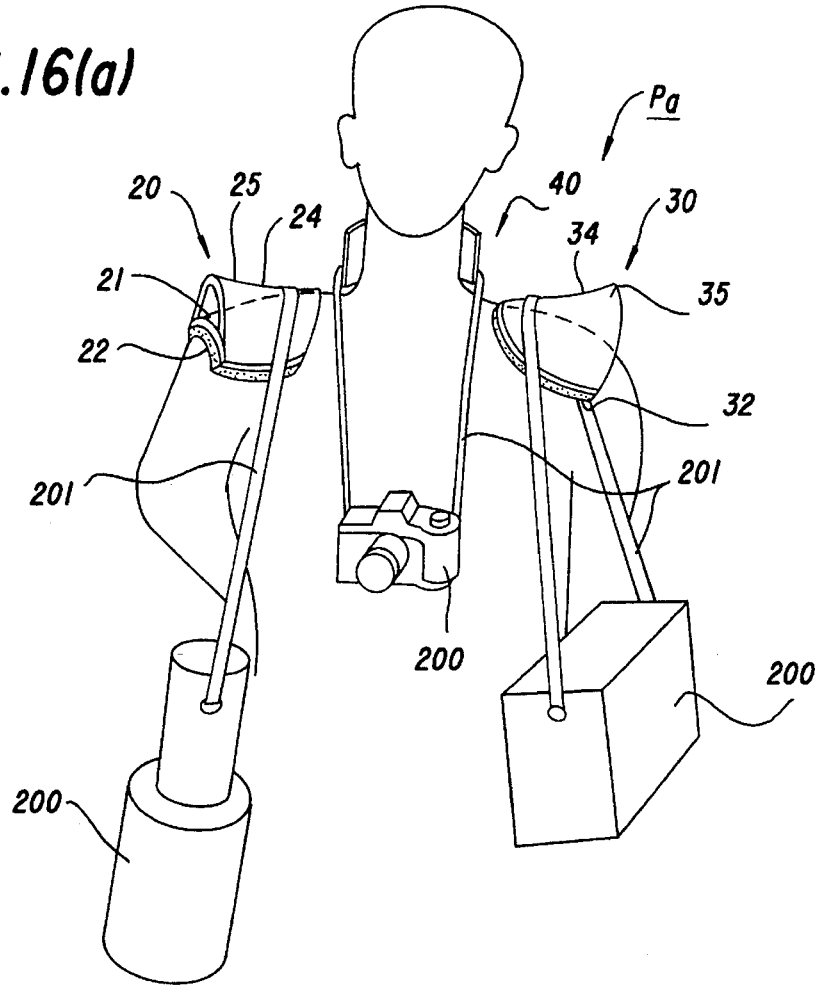
FIG.16(b)
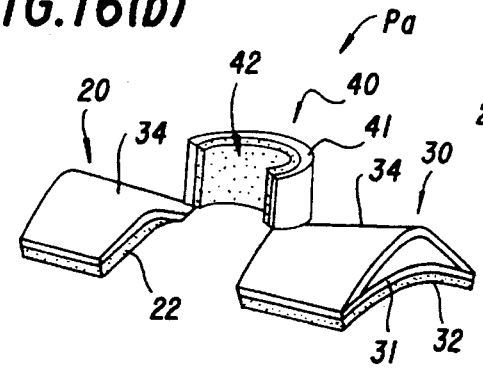
FIG.16(d)
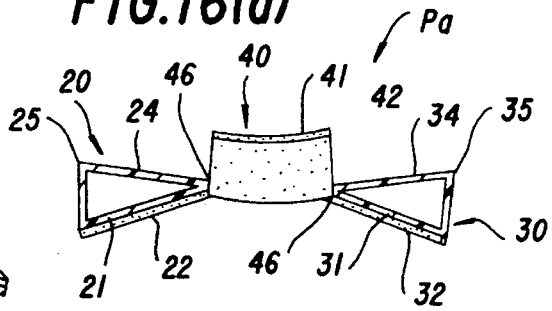
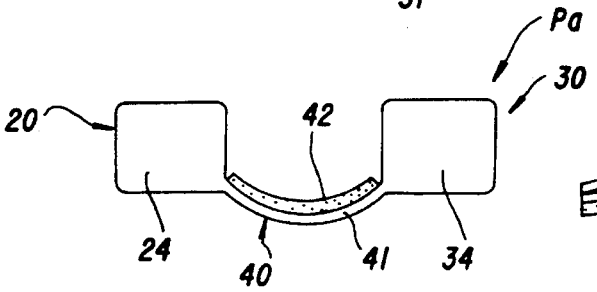
FIG.16(c)
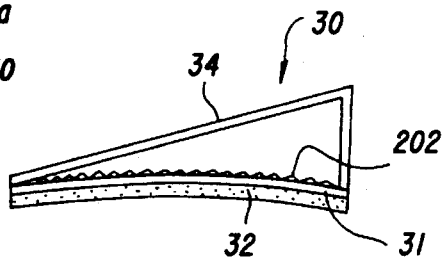
FIG.16(e)

FIG.19(a)
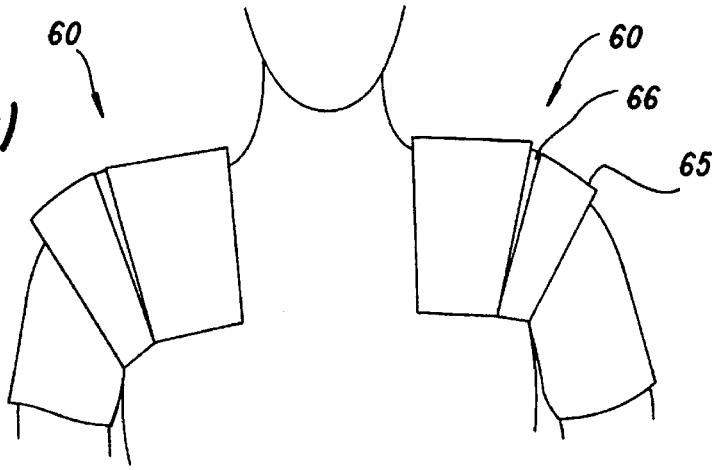
FIG.19(b)
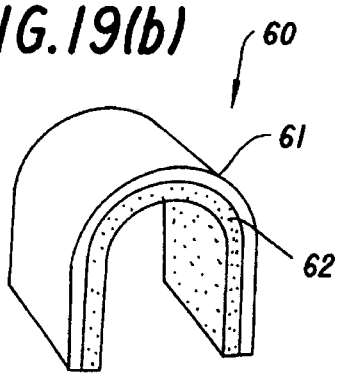
FIG.19(d)
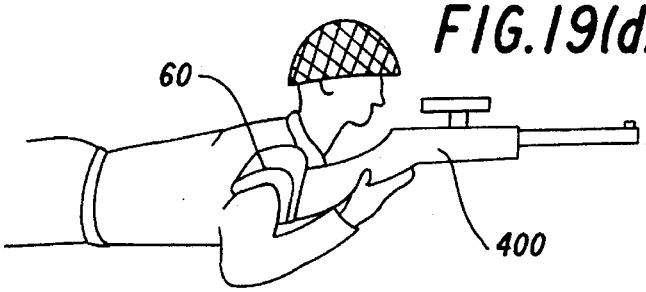
FIG.19(c)
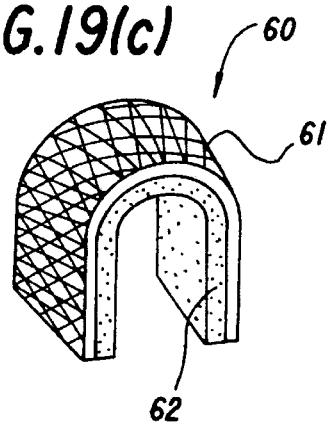
FIG.19(e)
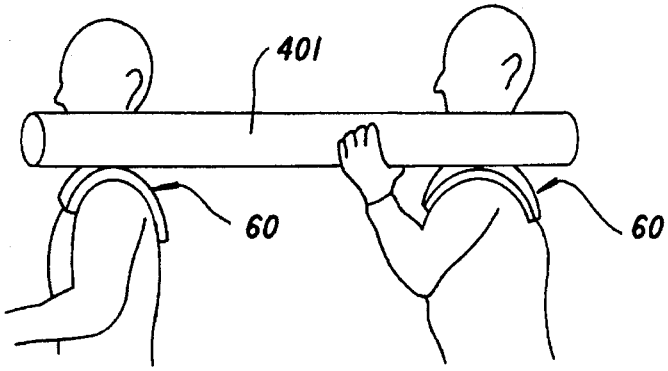
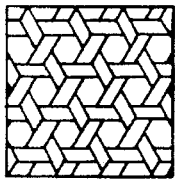
FIG.19(f)
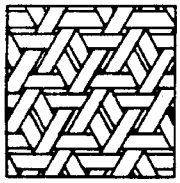
FIG.19(g)

FIG.20(b)
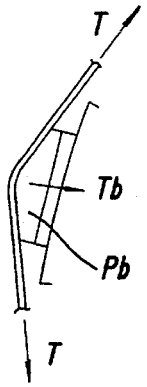
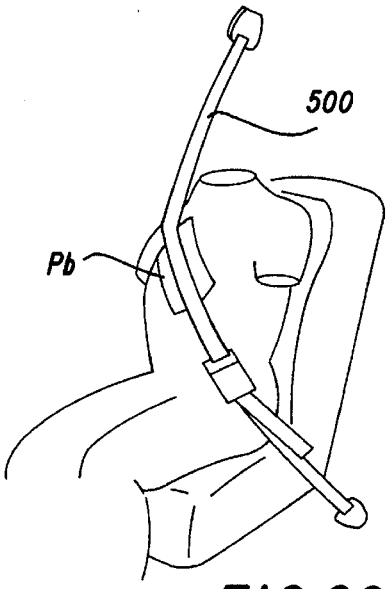
FIG.20(a)
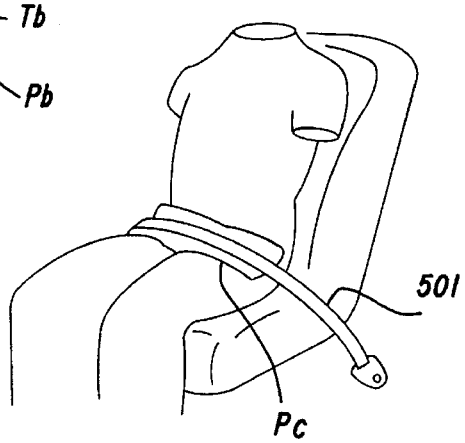
FIG.20(c)
FIG.21
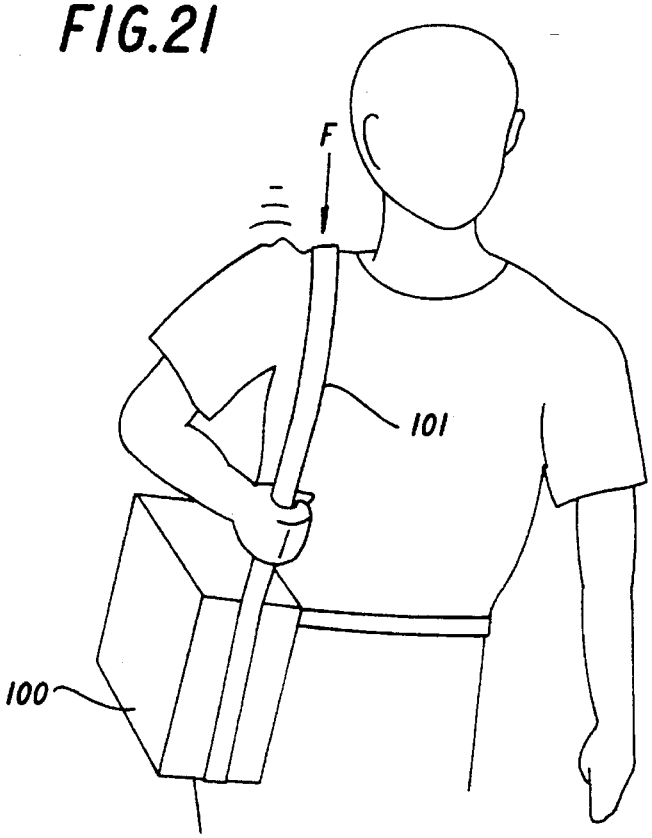

PROTECTOR

This application is a continuation of application Ser. No. 08/123,266, filed Sep. 20, 1993, now abandoned.

BACKGROUND OF THE INVENTION

1. Field of the Invention

The present invention relates to a protector which is placed on a local portion of a human body where a load is concentrically applied, thereby unburdening and protecting such local portion of the human body.

2. Description of the Related Art

Hitherto, no simple protecting pad has been proposed which would protect the human body against local concentration of load applied to the human body.

The "local load" acting on the human body is, for example, as shown in FIG. 21. The load F which is applied to a shoulder through a strap 101 which suspends a heavy article 100 such as a shoulder bag, a ruck sack, a tool box or a sports gear.

The weight of the article 100 such as a shoulder bag makes the strap 101 sink into the shoulder, thus burdening the shoulder excessively. In particular, the concentric application of the load through the strap 101 tends to cause pain in the muscle, as well as troubles such as internal hemorrhage or paralysis of peripheral nerve.

In order to obviate such inconvenience, hitherto, attempts have been made such as the use of a thick fur or woven cloth lining the back side of the portion of the strap 101 which is place on one's shoulder, or the use of a wide pad made of, for example, a leather. These attempts, however, are unsatisfactory because they cannot effectively eliminate the inconvenience such as pain in the shoulder.

The use of a strap 101 hanging from one's shoulder poses a problem even when the weight load F is not so large. Namely, since the shoulder declines from the neck toward the arm, the strap is apt to slide and come off the shoulder as the shoulder springs up and down during, for example, walking. Consequently, the user is obliged to carry his shoulder high, which undesirably burden muscles around the shoulder, often resulting in stiffness or pain in the shoulder.

SUMMARY OF THE INVENTION

Accordingly, an object of the present invention is to provide a protector which unburdens as much as possible the local portion of the human body under application of local load.

To this end, according to the present invention, there is provided a protector comprising a rigid protector member adapted to be placed on a local portion of a human body to receive a local load applied thereto so that the local load is distributed over the entire area of the body contact surface of the protector member.

Preferably, the body contact surface of the protector member is configured in conformity with the geometry of the human body.

It is also preferred that the protector employs a buffer member which is placed between the protector member and the human body.

It is also preferred that the protector member is partially deflectable.

It is also preferred that the length of the protector member is adjustable.

The protector of the invention can suitably be used particularly but not exclusively when the local load is a load applied to the human body through a strap.

In such a case, the protector member is preferably provided with a strap support for supporting the strap and,more preferably, a strap retainer is provided on the strap support.

When the protector of the invention is used for protecting a shoulder against local load applied through a shoulder strap, the strap support preferably has a heightened outer end portion so as to prevent the strap from sliding along and coming off the strap support. Preferably, the height of such outer end portion of the strap support is made adjustable.

Thus, the present invention is based upon an idea and design which are fruits of medical and human-engineering approach to the aforesaid problems, unlike the conventional solution, and provides practical effects which can never be achieved by the known solution.

More specifically, the load applied to the protector member of high rigidity is distributed over the entire area of contact between the protector pad member and the user's body, so that the level of the load on unit area is reduced so as to decrease burden on the user's body.

High uniformity of load distribution can be attained by designing such that the contact surface of the protector pad member is configured in conformity with the geometry of the user's body, because such a design enables the protector member to closely fit the local portion of the user's body without any clearance.

When a buffer member is placed in the contact region of the protector member, a greater comfort is obtained because of softness of the contact with the user's body. The buffer member also reduces any dynamic load such as impact load, thus attaining a further unburdening of the user's body.

BRIEF DESCRIPTION OF THE DRAWINGS

FIGS. 1(*a*), 1(*b*) and 1(*c*) are illustrations of an embodiment of the present invention applied to a shoulder protector suitable for use on one's shoulder to protect the shoulder against load applied for example, a shoulder bag, wherein FIG. 1(*a*) is a schematic perspective view, and Figs. 1(*b*) and 1(*c*) are schematic illustrations of he state of loading;

FIG. 5(*a*) and 5(*b*) are a front elevational view and a schematic perspective view of a critical portion of another form of the shoulder protector shown in FIG. 1(*a*) in the state of use;

FIGS. 6(*a*), 6(*b*) and 6(*c*) are a front elevational view, plane view and a perspective view, respectively, of a still another form of the shoulder protector shown in FIG. 1(*a*), and FIG. 6(*d*) is a schematic perspective view of a modification;

FIGS. 7(*a*) and 7(*b*) are a plane view and a front elevational view of a different form of the shoulder protector shown in FIG. 1(*a*) in the state of use;

FIG. 8 is a front elevational view of a different form of the shoulder protector shown in FIG. 1(*a*);

FIGS. 9(*a*) and 9(*b*) are illustrations of a different form of the shoulder protector shown in FIG. 1(*a*), wherein FIG. 9(*a*)

Figure 17:
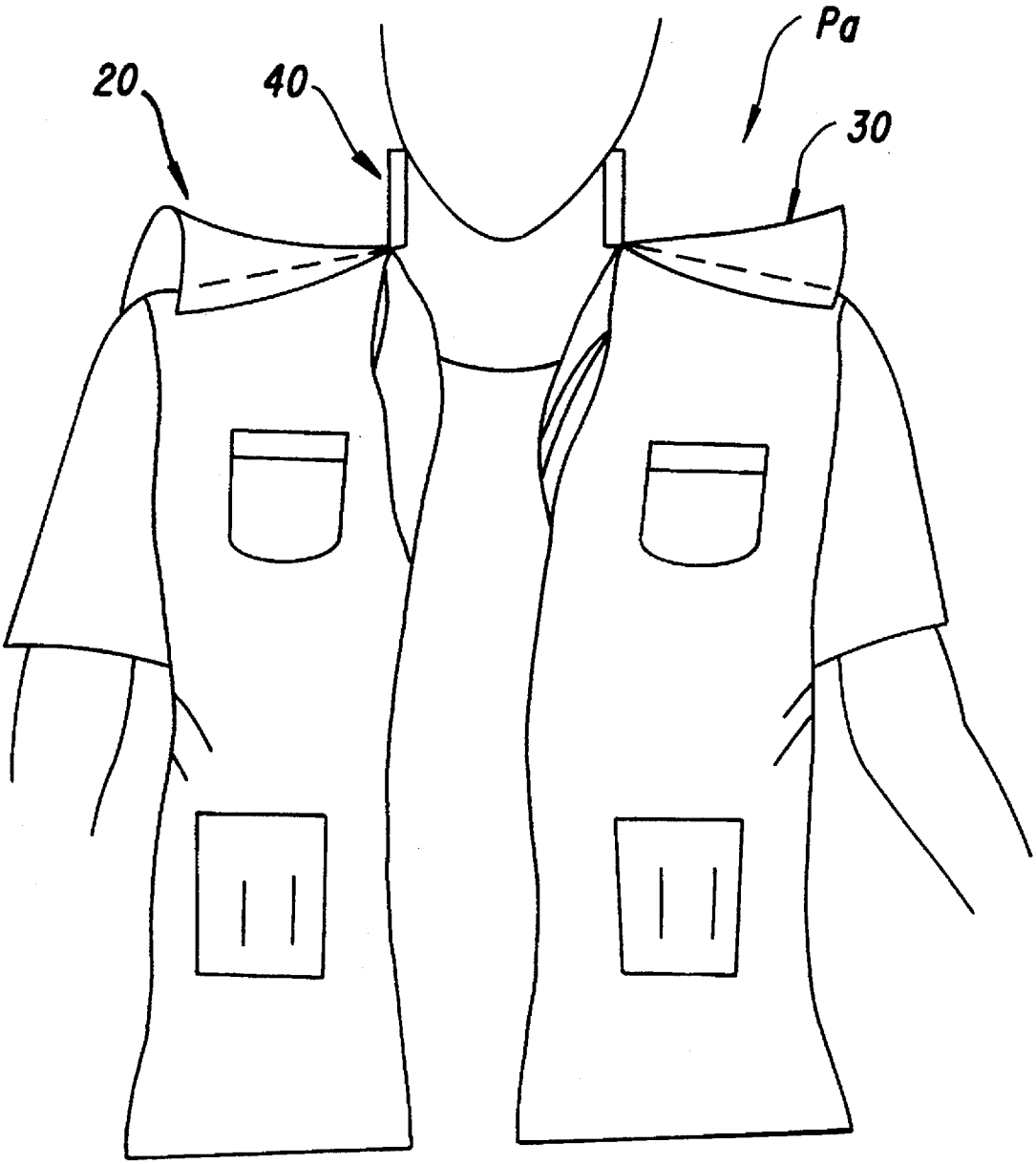
Figure 18A:
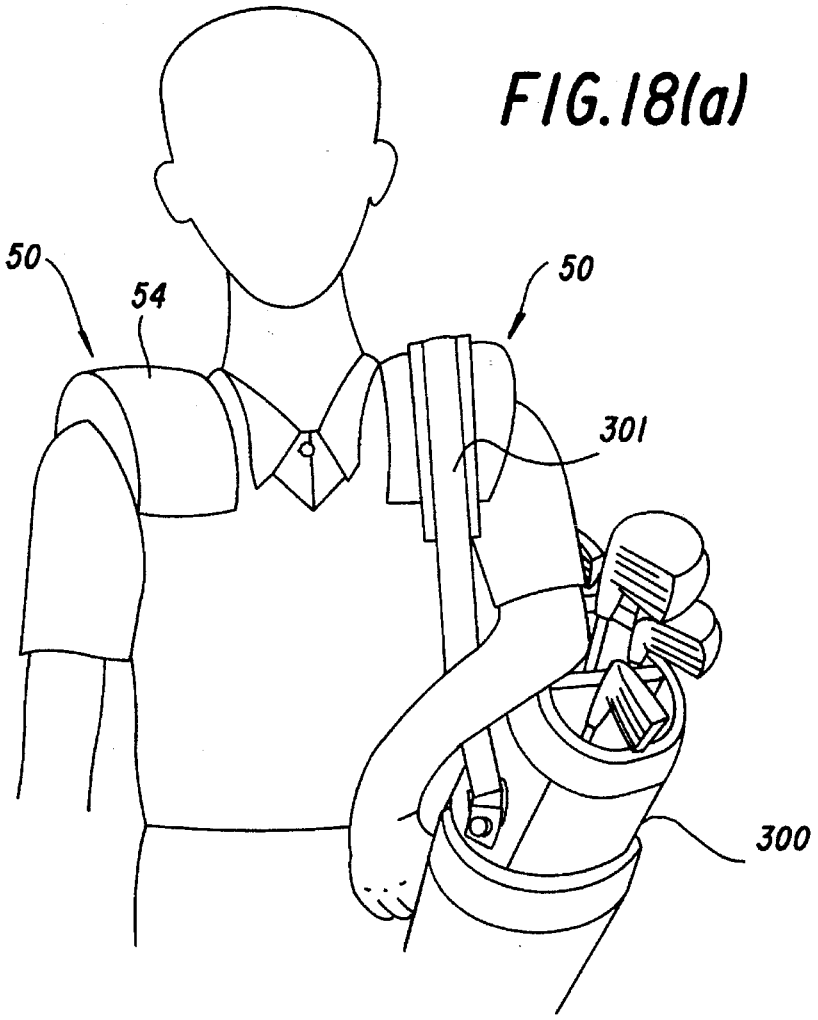
Figure 18B:
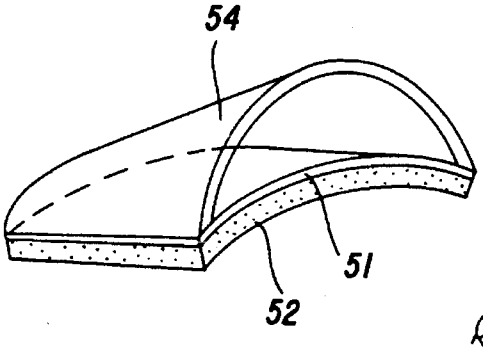
Figure 18C:
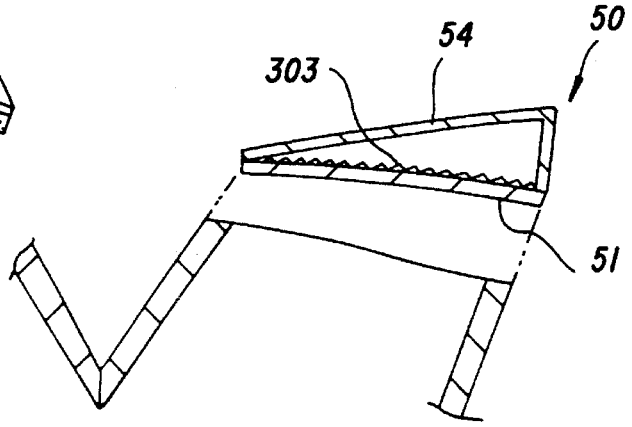

is a perspective view in a state in which a web-like fastener is in unfastening condition, while FIG. 9(*b*) is a perspective view in a state in which the fastener is in fastening condition;

FIG. 10 is a front elevational view of a different form of the shoulder protector shown in FIG. 1(*a*) in the state of use;

FIGS. 11(*a*), 11(*b*), 11(*c*) and 11(*d*) are a plane view, front elevational view, perspective view and a side elevational view of a different form of the shoulder protector shown in FIG. 1(*a*);

FIGS. 12(*a*), 12(*b*), 12(*c*) and 12(*d*) are a front elevational view, a perspective view, a top plane view and a side elevational view, respectively, of different form of the shoulder protector shown in FIG. 1(*a*), FIG. 12(*e*) is a front elevational view of a modification, and FIG. 12(*f*) is an illustration of a strap fastening means;

FIGS. 13(*a*), 13(*b*) and 13(*c*) are a plane view, a front elevational view and a side elevational view of a different form of the shoulder protector shown in FIG. 1(*a*), FIG. 1(*d*) is a perspective view illustrative of the principle of the protector of FIG. 13(*a*), and FIG. 13(*e*) is an illustration of the state of use of the protector shown in FIG. 13(*d*), and FIGS. 13(*f*) and 13(*g*) are a perspective view and a plane view of a different form of the shoulder protector shown in FIG. 13(*a*);

FIGS. 14(*a*), 14(*b*), 14(*c*) and 14(*d*) are a plane view in a contracted state, a side elevational view in the contracted state, a plane view in expanded state and a front elevational view in the expanded state, of a different form of the shoulder protector shown in FIG. 1(*a*);

FIGS. 15(*a*) to 15(*e*) are illustrations of a different form of the shoulder protector shown in FIG. 1(*a*), wherein FIG. 15(*a*) is a plane view, FIG. 15(*b*) is a front elevational view in a state in which an air bag has been deflated, FIG. 15(*c*) is a front elevational view in a state in which the air bag has been inflated, FIG. 15(*d*) is a side elevational view of the protector in the state shown in FIG. 15(*b*), and FIG. 15(*e*) is a side elevational view of the protector in the state shown in FIG. 15(*c*);

FIGS. 16(*a*) to 16(*e*) are illustrations of another embodiment of the protector in accordance with the present invention, suitable specifically for protecting both shoulders and the neck of, for example, a cameraman, wherein FIG. 16(*a*) is a front elevational view of the protector in use, FIG. 16(*b*) is a schematic perspective view of the protector, FIG. 16(*c*) is a plane view, FIG. 16(*d*) is a sectional front elevational view, and FIG. 16(*e*) is a sectional view of shoulder protecting portion with a portion of a suit sandwiched between two part of the shoulder protecting portion;

FIG. 17 is an illustration of a suit with which the protector shown in FIG. 16(*a*) is integrated;

FIGS. 18(*a*) to 18(*c*) are illustrations of a still another embodiment of the protector in accordance with the invention suitable for use when hanging a golf bag, wherein FIG. 18(*a*) is a front elevational view of the protector in use, FIG. 18(*b*) is a perspective view of the protector, and FIG. 18(*c*) is an illustration of the protector integrated with a suit;

FIGS. 19(*a*) to 19(*g*) are illustrations of a further embodiment of he protector in accordance with the invention, intended for use in combat, wherein FIG. 19(*a*) is a front elevational view of the protector in use, FIG. 19(*b*) is a schematic perspective view of an example of the protector of this embodiment, FIG. 19(*c*) is a schematic perspective view of a protector having bullet-proof function, FIG. 19(*d*) is an illustration of the protector used under a firearm, FIG. 19(*e*) is an illustration of the protector used in ordinary work, and FIGS. 19(*f*) and 19(*g*) are illustrations of an example of tri-axial woven cloth;

FIGS. 20(*a*) to 20(*c*) are illustrations of a different embodiment of the protector in accordance with the invention, intended for use together with a seat belt; and FIG. 21 is a schematic illustration of a person carrying a heavy article at high shoulder, illustrative of problems encountered in carrying such article.

DESCRIPTION OF THE PREFERRED EMBODIMENTS

Preferred embodiments of the present invention will be described with reference to the accompanying drawings.

FIGS. 1(*a*) to 4 show a first embodiment of the protector in accordance with the present invention, suitable for use in protecting one's shoulder when a heavy article 200 such as a shoulder bag, ruck sack, tool box or a sports gear is carried by the shoulder. This embodiment is intended to unburden the shoulder so as to reduce discomfort as much as possible, when reduction in the weight of the article 200 such as a bag is not allowed.

Referring to these Figures, the protector P has a shoulder pad or base plate 1 serving as a protector member, a buffer member 2 provided on the reverse side of the base plate 1, an anti-slip member 3 provided on the surface of the buffer member 2 and a strap support 4 provided on the base plate 1.

The base plate 1 is adapted to be placed on the user's shoulder so as to receive local load applied through a shoulder strap 201, so that the local load is distributed over the entire area of the base plate 1 thereby unburdening the shoulder.

The shoulder pad base plate 1 should have a width at least greater than that of the shoulder strap 201 of the shoulder bag or the like and is preferably large enough to sufficiently cover the user's shoulder. A too large size of the base plate degrades the appearance and handling. Therefore, when the protector P has a large size, it is preferred that the base plate 1 is formed from a plurality if segments which are hinged together, thus providing a foldable nature of the protector P.

The material, shape and dimensions of the shoulder pad base plate 1 are suitably determined to provide rigidity which is necessary for distributing the load. Various materials having strengths exceeding a certain level can be used as the material of the shoulder pad base plate 1. For instance, it is possible to use a metal, a synthetic resin such as celluloid, vinyl resin, phenol resin, urea resin, polyethylene, polypropylene, polyamide, glass-fiber-reinforced plastics (FRP), carbon-fiber-reinforced plastics (CFRP), ABS resin or a urethane resin, cloth, rubber, wood or paper. The surface of the shoulder pad base plate 1 may be painted or coated or lined with a synthetic resin, leather or a cloth, as required.

Preferably, the shoulder pad base plate 1, in particular the contact surface for contact with the human body, is configured in conformity with the configuration of the human body. From this point of view, the protector member is made from a flexible material having high formability so as to enable adjustment in accordance with the configuration of the portion of the human body to be protected. In the illustrated embodiment, the protector member has been bent in accordance with the curvature of a shoulder.

The buffer member 2 is provided over the entire area of the lower surface of the shoulder pad base member 1, in order to enable the base plate 1 to closely fit the shoulder and to buffer external force so as to provide a good feel of use. A sponge such as urethane foam, soft rubber, soft plastics, silicone rubber or a cushion charged with liquid or gas is suitably used as the material of the buffer member 2.

The anti-slip member 3 is provided for purpose of preventing slip of the base plate 1 on shoulder, and is stretched on the surface of the buffer member 2. The provision of the anti-slip member 3 is not essential. Namely, the anti-slip member 3 may be omitted when the buffer member 2 itself is made of a material having slip-prevention function. It is also possible to coarsen the surface of the buffer member 2 so as to impart the anti-slip function.

The belt support 4 is provided on the upper surface of the shoulder pad base plate 1 so as to project upward therefrom. The belt support 4 extends over the entire length of the shoulder pad base plate 1 along the axis thereof. The upper surface of the belt support 4 is tapered such as to increase the height towards the end adjacent to the arm so as to provide a heightened end 5 which prevents the shoulder strap 201 from coming off.

Figure 2A:
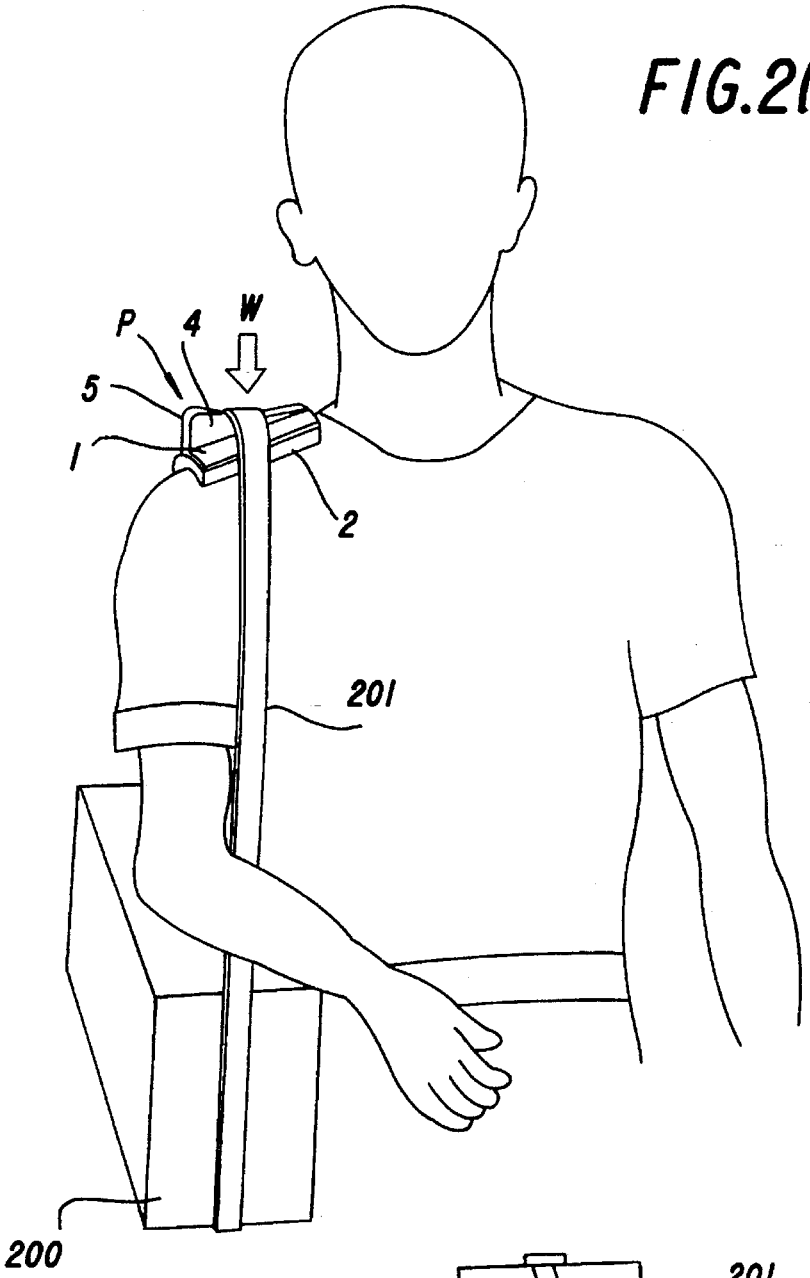
FIGS. 2(*a*) and 2(*b*) are respectively a front elevational view and a plane view of the protector shown in FIG. 1(*a*)
Figure 2B:
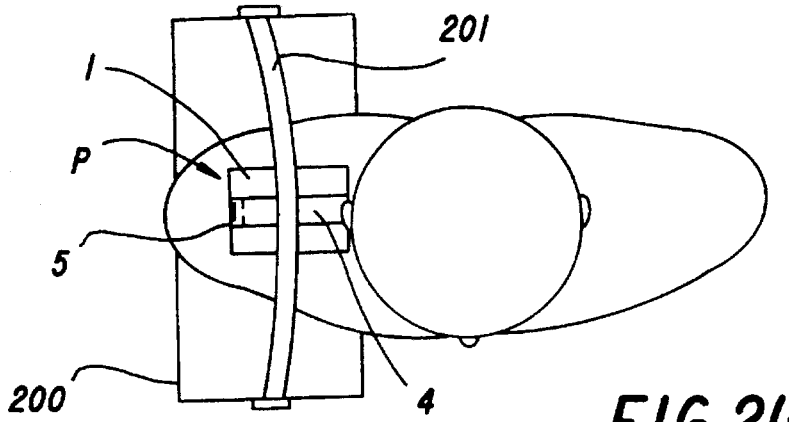

In use, the protector P is placed on the shoulder, and a shoulder strap 201 suspending a heavy article 200 such as a bag is retained on the protector P, as shown in FIG. 2.

The area of the shoulder on which the shoulder strap 201 is held is almost fully covered by a trapezius, so that the shoulder pad base plate 1 is placed on the upper edge of the trapezius. Various muscles such as musclus levator scapulae and so forth. It is considered, however, any load applied to the shoulder is borne almost fully by these two types of muscles, as well as by scapular and collarbone associated with these muscles.

The concentric load W applied to the base plate 1 through the shoulder strap 201 is distributed over the entire area of contact between the shoulder pad base plate 1 and the shoulder, so that the load w0 acting on unit area of the human body is small. Consequently, the weight of the article 200 is applied in good balance of distribution over the upper edge of the trapezius, thus preventing problems such as occurrence of scytitis, internal hemorrhage or paralysis of peripheral nerve. In particular, when the contact surface of the shoulder pad base plate 1 for contact with the shoulder is configured in conformity with the configuration of the body, the base plate 1 can closely fit the shoulder without any clearance, thus providing good feel of use.

In this embodiment, since a buffer member 2 is provided on the contact surface of the base plate 1, the base plate softly acts on the shoulder so as to further improve the feel of use.

In actual use, as the user carrying the heavy article 200 at his shoulder moves, the heavy article 200 moves up and down and to the left and right so that the load is applied dynamically. In particular, the load is applied in an impacting manner when the user moves vigorously. In the illustrated embodiment, however, such an impact is effectively absorbed by the buffer member 2. FIG. 1(*c*) illustrates the mechanism of buffering a dynamic load using a model of the mechanism. The buffer member 2 can be represented as being a spring system having a dash pot.

It is to be noted, however, that the use of the buffer member 2 is not essential. Namely, the shoulder can be greatly unburdened simply by distributing the load, as will be seen from a model shown in FIG. 1(*b*).

In the illustrated embodiment, the belt support 4 has an heightened outer end as denoted by 5, so that sliding of the shoulder strap 201 down along the shoulder is avoided without requiring the user to carry the shoulder high, which remarkably reduces fatigue of the shoulder. Preferably, the height of the heightened outer end portion 5 of the belt support 4 is made adjustable, so that a single protector can be adapted to a variety of shapes and sizes of the shoulder, i.e., regardless of whether the user is a male or female or an adult or a child and irrespective of the gradient of the slope of the shoulder.

Figure 3:
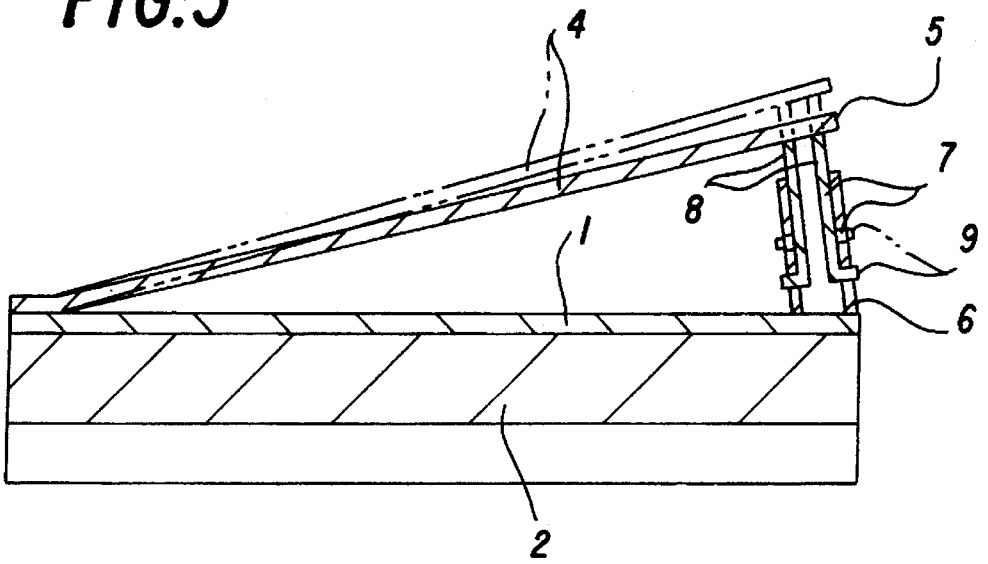
FIG. 3 is a schematic sectional view of a strap support adjusting mechanism incorporated in the protector shown in FIG. 1(*a*)

FIG. 3 illustrates an example of the height adjusting device. The height adjusting device has a guide sleeve 6 provided on the shoulder pad base plate 1. The guide sleeve 6 has a plurality of vertically-spaced retainer holes 7, 7. The guide sleeve 6 is adapted to receive an elastic adjusting rod 8 which is provided with retaining projections 9 for cooperation with the retainer holes 7. In use, the retainer projection 9 engages with selected retainer hole 7, thus enabling adjustment of the height of the heightened outer end portion 5 of the strap support 4. The described height adjusting mechanism is only illustrative and may be substituted by any suitable mechanism having similar function.

Figure 4:
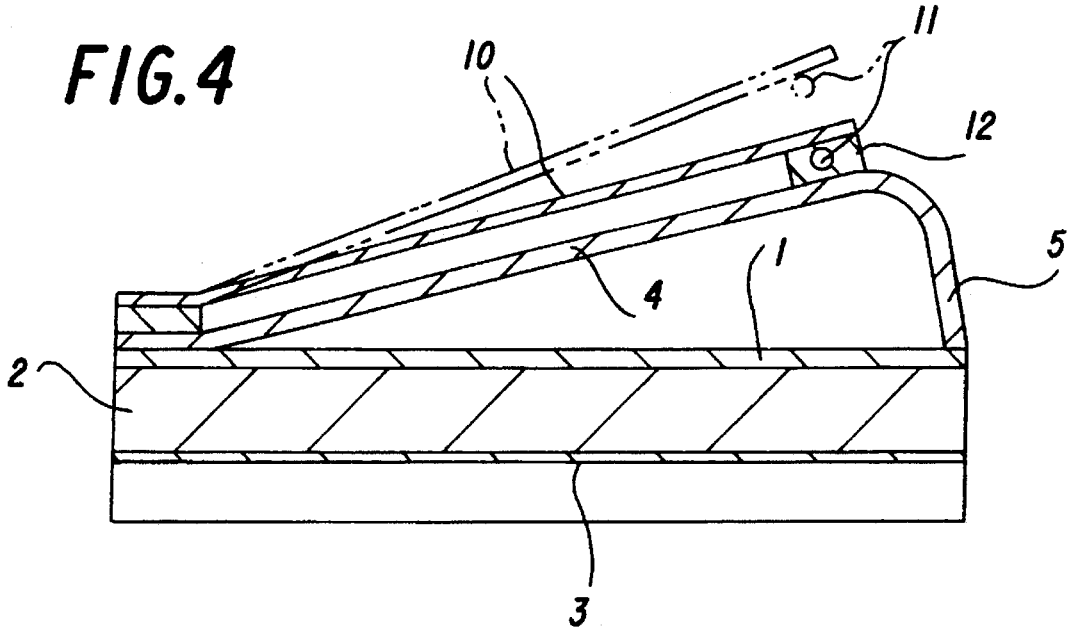
FIG. 4 is a schematic sectional view of an example of a strap retainer used in the embodiment shown in FIG. 1(*a*)
Figure 12A:
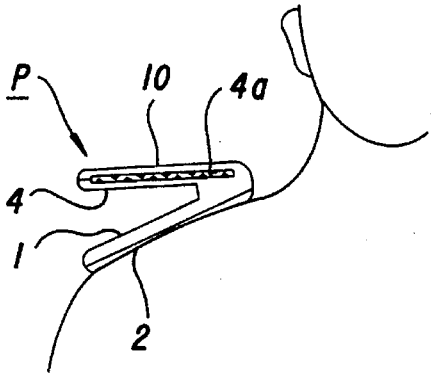
Figure 12B:
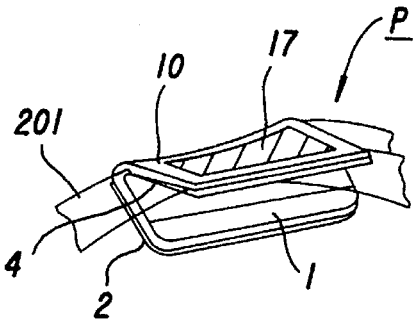
Figure 12C:
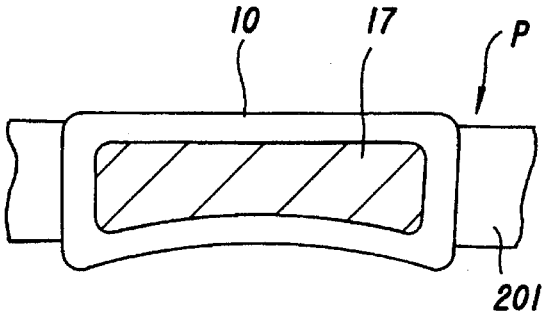
Figure 12E:
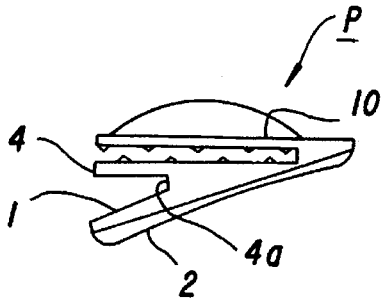
Figure 12D:
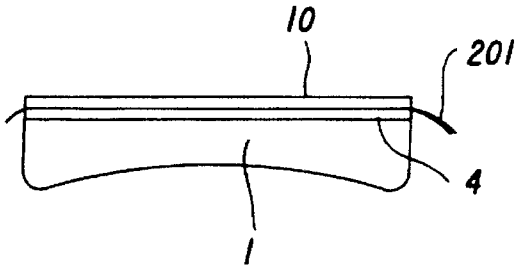
Figure 12F:
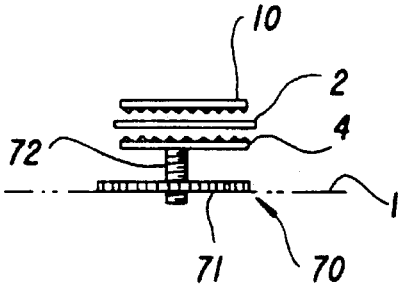

The strap support 4 may be provided on the upper surface thereof with a strap retainer 10 which prevents the shoulder strap from sliding on and coming off the strap support 4. FIG. 4 illustrates an example of such a strap retainer. A belt retainer member 10 is fixed at its base end to the strap support 4, while the other end of the strap retainer member 10 is provided with a snap ball 11 for an engagement with a snap hole 12 formed in the strap support 4. This construction is only illustrative and any other suitable arrangement having a similar function may be used, such as, for example, a web-like fastener. The strap retainer member 10 effectively prevents the strap 201 from shifting on the strap support 4, so that the outer end portion 5 need not be specifically heightened.

Although in the illustrated embodiment the protector is constructed as a member separate from the strap, this is only illustrative and the protector may be formed integrally with the strap.

FIGS. 5(*a*) to 15(*e*) illustrate various forms of the embodiment of the protector shown in FIG. 1(*a*).

FIGS. 5(*a*) and 5(*b*) show a protector in which flexible web-type fastener 13 is used as the strap retainer. The web-type fastener 13 has fastening portions 13*a* both on the outer end portion 5 of the strap support 4 and the end adjacent the neck.

FIGS. 6(*a*) to 6(*c*) show a protector in which the shoulder pad base plate 1 has a substantially I-shaped configuration, constituted by a linear straight portion 1A which linearly extends along the upper edge of the shoulder, and flanges 1B which are provided on both ends of the straight portion 1A so as to project forward and backward from these ends. Each flange 1B is curved downward in conformity with the shape of the shoulder. This protector can be formed easily because what is needed is to bend the flanges 1B in conformity with the configuration of the shoulder. The shoulder pad base plate may have three or more flanges 1B as shown in the modification shown in FIG. 6(*d*). The protector shown in FIGS. 6(*a*) to 6(*d*) also employs a web-type fastener 13 as means for retaining the strap.

FIGS. 7(*a*) and 7(*b*) show a protector in which the strap support 5 is widened to have a width substantially equal to that of the shoulder pad base plate 1 so as to provide a more stable support for the strap 201. In this case, a web-type fastener 14 is used for fixing the protector P to the shoulder. Namely, anchoring portions of the web-type fastener 14 is provided on the shoulder portion of the suit so as to enable the protector P to be fixed to the shoulder portion of the suit.

FIG. 8 shows a protector in which the strap support 4 has an increased width and the upper surface of the strap support 4 is curved so as to provide a greater stability for the support of the strap 201. This protector also employs a web-type fastener as means for retaining the strap.

FIG. 9(*a*) and (*b*) show examples each in which a belt support 4 is formed with a wide width, as shown in FIG. 8, an upper surface of the base plate 1 is formed to provide a curved surface, and the shoulder belt 201 is applied to the belt support 4 by supporting the shoulder strap 201 by means of the web-type fastener 13.

FIG. 10 shows a protector in which the whole strap support 4 is configured to have a shape of a suitable character such as a hero of a comic or an animal.

FIGS. 11(*a*) to 11(*d*) illustrate a protector in which a guide groove 15 for receiving the strap 201 is formed in the upper surface of the shoulder pad base plate 1. A flexible strap retainer 16 is provided so as to cover the guide groove 15 thereby retaining the strap 201. The strap retainer 16 is fixed at its one end to one side of the base plate 1, while the other end is wound on the shoulder pad base plate 1 so as to retain the strap 201 and releasably fixed to the other end of the shoulder pad base plate 1.

FIG. 12 illustrates a protector in which a strap support 4 and a shoulder pad base plate 1 are rigidly integrated with each other at a predetermined angle to each other so as to exhibit a substantially V-shaped cross-section. The portion 4*a*of the protector where the strap support 4 and the shoulder pad base plate 1 are rigidly connected to each other has a thickness which is increased as required. A strap retainer 10 is provided on the upper surface of the strap support 4. The strap retainer 10 may be cut-away at its portion hatched in the FIG. 12(*c*) so as to make the strap 20 visible therethrough. The strap retainer 10 itself may be made from a pipe-like material.

The protector also may have a mechanism which fastens the strap 201 by cooperation between the strap retainer 10 and the strap support 4. FIG. 12(*f*) shows a screw-type fastening mechanism 7 which employs a screw member 72 screwed into a dial 71 which is supported rotatably but not axially movably. The support for the dial 71 may be such that the dial 71 does not move at least axially away from the strap support 4, e.g., by utilizing the shoulder pad base plate 1. The screw member 71 is connected at its one end to the strap support 4 so that the strap support 4 is moved through the action of the screw member as the dial 71 is rotated. The illustrated screw type fastening mechanism is only illustrative and may be substituted by other suitable mechanism such as that using a spring, provided that the mechanism can clamp and fasten the strap 201.

FIGS. 13(*a*) to 13(*e*) show a protector in which a shoulder pad base member 1 is made of a highly rigid material and is provided with flexible portions so as to be deformed in conformity with the configuration of the user's body.

In this case, the base plate 1 is segmented into a plurality of pieces 1P, 1P which are connected to adjacent ones through connecting members 18, 18 which serve as the above-mentioned flexible portions. A buffer member 2P is provided on the body-contact portion of each of the pieces 1P, 1P.

Each piece 1P of the base plate 1 is provided with a strap retainer 10P for retaining the strap 201. The arrangement is such that the strap 201 is received in the gap between the piece 1P and the strap retainer 10P.

The described segmented structure enables that the whole base plate is flexed at the connecting members 18, 18 between the pieces 1P,1P in conformity with the curvature of the user's body, thus making a close fit on the user's body as shown in FIGS. 13(*d*) and 13(*e*).

FIG. 13(*f*) and (*g*) show an example in which a plurality of pieces 1P, 1P,—are applied to one buffer member 2. Namely, a plurality of pieces 1P are arranged side by side on an upper surface of the buffer member 2, and each of the pieces 1P has an outer side of the shoulder having a height higher than a height of an inner side thereof so as to provide a tapered inclination from the shoulder outer side towards the shoulder inner side. As shown in FIG. 13(*g*), the buffer member 2 is slightly curved towards the outer side of the shoulder in a plan view along the belt 201. Further, a pair of strap retainers 10, 10 are attached to both ends of the upper surface of the buffer member 2 so as to arrange the pieces 1P therebetween.

FIGS. 14(*a*) to 14(*d*) show a protector in which the length of the shoulder pad base plate 1 is adjustable.

In this case, the base plate 1 is composed of a left piece 1L, a right piece 1R and a connecting tab 19 interconnecting these pieces 1L, 1R. The left and right ends of the connecting tab 19 are slidably inserted into holes formed in the left and right pieces 1L, 1R, respectively.

FIGS. 15(*a*) to 15(*e*) show a protector incorporating an air bag as the buffer member 2. More specifically, the protector as illustrated employs air bags 2P1, 2P2 and 2P3 of different sizes. The air bags 2P1, 2P2 and 2P3 are inflated by air when the protector is to be used.

FIGS. 16(*a*) to 16(*e*) illustrate an embodiment of the protector in accordance with the present invention, improved to protect not only one shoulder but also the other shoulder and the neck of the user simultaneously. A professional person, e.g., a cameraman, is often obliged to work while hanging heavy articles from both shoulders and neck, thus suffering from heavy fatigue at both shoulders and the neck. The protector shown in FIGS. 16(*a*) to 16(*e*) is intended to relieve such person from fatigue. It will be understood that this protector can remarkably reduce fatigue and pain.

This protector Pa is composed of left and right shoulder protecting portions 20, 30 and a central neck protecting portion 40.

Each of the left and right shoulder protecting portions 20, 30 may have a construction basically the same as those shown in FIGS. 1(*a*) to 15(*e*). Namely, these portions 20, 30 have, respectively, shoulder pad base plates 21, 31 made of a high-rigidity material having comparatively large strength such as plastics, and buffer members 22, 32 such as sponge material provided on the inner side of these base plates 21, 31. The protector also has strap supports 24, 34 on the base plates 21, 31. The strap supports 24, 34 are so tapered as to increase the height towards the outer ends, i.e., the ends closer to arms, thereby preventing the strap 201 from sliding on and coming off the strap supports.

The neck protecting portion 40 of the protector is composed of a neck pad base plate 41 which is adapted to be placed on the back side of the neck and a buffer member 42 which is interposed between the neck pad base plate 1 and the neck. The neck pad base plate 41 is curved in conformity with the curvature of the back portion of the neck, such that it has a neck contact region of an area greater than the loading area of the strap 201 wound around the neck, thereby distributing the load to be applied to the neck over a wide area.

The neck pad base plate 41 is connected to the left and right base plates 21, 31, so that the neck protecting portion 40 of the protector is supported on both shoulders through the left and right shoulder protecting portions. Consequently, the load acting on the neck protecting portion 40 is borne not only by the neck but also by both shoulders, through the left and right shoulder protecting portions 20, 30.

The connection between each shoulder pad base plate 21, 31 and the associated end of the neck pad base plate 41 is achieved by a hinge 46 so as not to impede motion of the shoulder. It is to be understood, however, that the shoulder protecting portions 20, 30 and the neck protecting portion 40 need not always be integrated but may be formed separately. In particular, when these protecting portions are used in combination with a specific shirt or a vest, these protecting portions may be independently be incorporated in and held by such a shirt or vest.

When the protector is incorporated in a shirt or a vest, each protecting portion may be sewed into the shirt or vest or, alternatively, the cloth 202 of the shirt or the vest may be sandwiched between the base plate 31 and the strap support 34. It is also possible to fix these protecting portions by bonding or other suitable fixing method. Needless to say, these protecting portions may be provided either on the inner side or outer side of the shirt or vest.

FIG. 17 illustrates an example of a vest incorporating shoulder protecting portions 20, 30 and neck protecting portion 40 of the protector. Obviously, these protecting portions 20, 30, 40 may be detachable from the vest.

The use of the protector Pa eliminates the necessity for raising the shoulder, while preventing strap from pressing into a local portion of the shoulder and reducing the burden on the neck, thus remarkably suppressing fatigue and stiffness in the shoulders and the neck, as well as pain.

Although this protector Pa is designed to protect three portions: namely, both shoulders and the neck, this is only illustrative and the protector Pa may be designed to protect only one shoulder together with the neck or only the neck of the user.

FIGS. 18(*a*) to 18(*c*) illustrate an embodiment of the protector in accordance with the invention, intended specifically for hanging a golf bag.

In general, a golf bag 300 has a large size so that the protector 50 preferably is sized to have an area large enough to cover the whole shoulder in order to stably hold a strap 301.

In the illustrated case, the protector 50 covers the entire breadth of the shoulder, from the end near the neck to the end near the arm.

In addition, since the golf bag tends to swing largely during carrying, it is preferred that the buffer member 52 has a large thickness to provide a greater impact absorbing performance.

Preferably, this protector is integrated with clothes such as a vest 303 such that the shoulder pad base plate 51 and the buffer member 52 are placed on the inner side of the vest while the strap support 54 appears on the upper or outer side of the vest. The shoulder pad base plate 51 and the strap support 54 of the protector 50 may be formed integrally with or separately from each other. It is also possible to incorporate these parts in the clothes.

The protector 50 may be provided to protect either one of the shoulders. Considering that the golf bag is often switched from one to the other shoulder, it is preferred that a pair of protectors 50 are used to protect both shoulders.

FIG. 19 illustrates an embodiment of the protector in accordance with the present invention suitable for use as a protecting gear in combat or the like condition.

This protector 60 basically has a construction similar to that shown in FIG. 1(*a*). Namely, the protector 60 has a hard shoulder pad base plate 61 having high rigidity, and a buffer member 62 made of a soft material such as a sponge for soft and close fit with the human body. In a major way of use, the stock of a gun is placed on the protector as shown in FIG. 19(*d*) or the protector is placed on a shoulder when a heavy article 400 is carried,as shown in FIG. 19(*e*), so as to protect the shoulder.

Considering the danger encountered in a combat, the shoulder pad base plate 61 is preferably made of a material which has a strength high enough to provide a bullet-proof nature, as shown in FIG. 19(*c*). More specifically, the base plate 61 is made of a material reinforced with carbon fibers or aramid fibers, or light-weight material such as a tri-axial woven cloth woven from such a material. FIG. 19(*f*) illustrates an example of commonly used tri-axial woven cloth. Needless to say, the tri-axial woven cloth is only an example. The protector 60 of this embodiment features an outer side portion 65 which protects the region of the user's body around the acromion and the triceps muscle of the arm. The outer side portion 65 is secured through a hinge 66 to the shoulder pad base plate 61 so as not to impede the motion. Alternatively, the outer side portion 65 itself is made from a flexible material, instead of using the hinge 66.

FIGS. 20(*a*), 20(*b*) and 20(*c*) show an embodiment of the protector in accordance with the present invention, intended for use on a region of a human body which is restrained by a seat belt of an automobile or an aircraft.

FIG. 20(*a*) shows the case where a seat belt 500 is wound on the breast of a human body. Any impact due to, for example, a collision acts on the breast through the seat belt 500. In this embodiment, therefore, the protector Pb is placed on the region of the breast restrained by the seat belt 500, so as to distribute the load thereby relaxing impact which may be applied through the seat belt. The construction of the protector Pb may be substantially the same as that in any one of the preceding embodiments described with reference to FIGS. 1(*a*) to 19(*g*), so that it is omitted from the drawings. Basically, however, the protector Pb has a highly rigid breast pad base plate configured in conformity with the geometry of the user's breast and a buffer member interposed between the breast and the base plate. Preferably, the upper surface of the protector Pb is convexed to provide a greater height so that the component Tb of the tensile force T applied to the seat belt 50 is applied to the protector Pb. According to this arrangement, the protector Pb is moderately pressed against the user's body by the force component Tb so that the protector can stably be held between the seat belt and the user's body.

FIG. 20(*c*) illustrates the case where the seat belt 501 is wound around the chest of the user. Thus, the protector Pc is placed under the portion of the seat belt 501 around the chest of the user. Although not shown in detail, this protector Pc has a highly rigid chest pad base plate configured in conformity with the geometry of the user's chest, with a suitable buffer member between the seat belt and the base plate.

Both the protectors Pb and Pc may be of the type which is provided inside clothes contacted by the seat belt or may be formed integrally with such clothes.

Although a three-point anchor type seat belt is specifically shown, this is only illustrative and the protector of this embodiment can equally be applied to other types of seat belts such as those supported at four or 6 points.

The protector in accordance with the present invention also may be applied for uses which are not illustrated. For instance, the protector of the present invention may be used to protect a human body against the load applied through a strap carrying a baby. A strap for carrying a baby, particularly for carrying the baby at the front side of the mother's body, is stretched from one shoulder to the opposite side of the chest of the body so as to press the shoulder and breast. It is therefore preferred that protectors of the invention are used to protect not only the shoulder but also the breast of the body. In such a case, the protector to be used on the breast is preferably heightened at the surface for engaging the strap as in the case of the protector explained in connection with FIG. 20(*b*) so that a component force of the tension acting on the seat belt. With such an arrangement, the load which otherwise may be borne by the shoulder is carried also by the breast portion of the body and the protector is caused to closely fit on the breast of the user, thus offering stable support for the protector.

In the embodiments described hereinbefore, protectors are intended to protect local portions such as neck, shoulder or shoulders, breast or chest. It is to be understood, however, the protector of the present invention can be constructed to protect various other local portions of human body, such as, for example, head, torso, elbow, back of hand, fist, knee, foot and so forth, where load is concentrically applied.

As will be understood from the foregoing description of structural features and advantages, the protector of the present invention effectively distributes local load over a wider area of the user's body by virtue of the protector member having high rigidity, thus remarkably relieving the user from fatigue and pain.

What is claimed is:

1. A protector for a shoulder of a wearer comprising:

an inner layer for contacting a shoulder of a wearer and made of a flexible buffer material and extending along a direction crossing a shoulder line connecting a neck portion and an arm portion of the wearer;

an outer layer formed on said inner layer and made of a rigid material and composed of a plurality of pieces disposed on the inner layer and being parallel with each other in the direction substantially along the shoulder line;

a strap member disposed on said outer layer to uniformly distribute the load_ applied on the outer layer entirely throughout the outer layer; and a connection member connecting said pieces respectively, wherein said pieces have inflexible property, said connection member is bent when the protector is worn on the shoulder of a user to fit therewith and the load locally applied on the outer layer is uniformly distributed by said strap member to thereby apply the distributed load uniformly on the shoulder through the inner layer.

2. A protector according to claim 1, wherein said protector member has a strap retainer.

3. A protector according to claim 2, wherein said strap retainer is provided for each of said pieces of the outer layer.

4. A protector according to claim 2, wherein said strap retainer is provided for each of front and rear end portions of the outer layer.

5. A protector according to claim 1, wherein said protector is adapted to be placed on one of the shoulders of the user, and upper surfaces of said pieces of the outer layer are tapered so as to provide a heightened outer end portion remote from the neck portion of the user to thereby prevent said strap from sliding on or coming off said pieces of the outer layer.

6. A protector according to claim 5, wherein each of said pieces of the outer layer has a substantially rectangular cross section to provide a shape such that the piece has a thickness gradually increasing from the neck portion to an outer side of the user when worn and said inner layer has substantially a uniform thickness in the same direction.

7. A protector according to claim 1, wherein said inner layer is formed of a plurality of pieces, each piece being applied to a corresponding piece of the outer layer.

8. A protector according to claim 1, wherein said inner and outer layers are formed of material different from each other.

9. A protector according to claim 1, wherein said inner and outer layers are formed of the same material having different rigidity.

10. A protector according to claim 1, wherein the plurality of pieces are connected to adjacent pieces through connecting members.

11. A protector according to claim 1, wherein said inner layer is composed of a buffer member having a single sheet shape fittable along the shoulder line, said pieces constituting the outer layer are disposed on said inner layer and said connection member is composed of portions of the inner layer disposed between adjacent pieces, respectively.

12. A protector according to claim 11, wherein said inner layer has front and rear end portions which are bent outward with respect to the shoulder in a plan view.

* * * * *